US007681819B2

(12) United States Patent
McBride

(10) Patent No.: US 7,681,819 B2
(45) Date of Patent: Mar. 23, 2010

(54) DISC ADJUSTMENT SYSTEM FOR CHIPPER APPARATUS

(75) Inventor: Daniel R. McBride, Carthage, NY (US)

(73) Assignee: CEM Machine, Inc., Carthage, NY (US)

( * ) Notice: Subject to any disclaimer, the term of this patent is extended or adjusted under 35 U.S.C. 154(b) by 674 days.

(21) Appl. No.: 11/598,585

(22) Filed: Nov. 13, 2006

(65) Prior Publication Data

US 2008/0110525 A1 May 15, 2008

(51) Int. Cl.
*B02C 1/08* (2006.01)
*B02C 7/14* (2006.01)

(52) U.S. Cl. ..... 241/242; 241/259.1

(58) Field of Classification Search ..... 241/92, 241/242, 259.1, 296; 144/36, 44, 172, 174, 144/220, 235; 407/36, 44
See application file for complete search history.

(56) References Cited

U.S. PATENT DOCUMENTS 4,390,132 A 6/1983 Hutson et al.
4,423,758 A 1/1984 Haller et al.
4,480,667 A 11/1984 Vaittinen et al.
5,080,153 A 1/1992 Waterman
5,274,899 A 1/1994 Sentagnes et al.
5,348,064 A 9/1994 Nettles et al.
5,417,263 A 5/1995 Jorgensen
5,727,611 A 3/1998 Kalliokoski
6,938,656 B2 9/2005 Plouffe et al.

OTHER PUBLICATIONS

International Search Report and Written Opinion of the International Searching Authority, Mailed Apr. 2, 2008, (5 pages), USA.

*Primary Examiner*—Faye Francis
(74) *Attorney, Agent, or Firm*—Hiscock & Barclay, LLP

(57) ABSTRACT

An adjustment mechanism for a rotary disc chipper apparatus includes an axially displaceable shaft attached to a chipper disc, at least one gear disposed in relation to the axially adjustable shaft and a drive member engageable with the at least one gear to produce axial movement of the axially displaceable shaft and the chipper disc.

19 Claims, 6 Drawing Sheets

DISC ADJUSTMENT SYSTEM FOR CHIPPER APPARATUS

FIELD OF THE INVENTION

This invention relates to wood chippers and more particularly to a system and a related method for adjusting the blade clearance in a disc chipper apparatus.

BACKGROUND OF THE INVENTION

A chipper apparatus or "chipper" is used in the field of lumber pulp production to process logs and to cut them or "chip" them into smaller pieces. In so-called "disc" chippers, a large rotary disc retains a series of radially disposed cutting knives on a facing surface of the disc. This disc can be adjusted in relation to a stationary cutting knife, commonly referred to by those of ordinary skill in the field as a "bedknife" or "anvil".

The large rotary disc is usually mounted for rotation onto a shaft that is driven by either an electric or diesel motor that may be coupled to a gear box. The chipper disc and shaft are held by two (2) large bearings. These bearings are affixed to the driven shaft, but are allowed to move axially in their respective housings. An exemplary setup of this type is shown in FIG. 3. Adjustment of the rotary disc permits the proper distance to be set from the radially disposed cutting knives in relation to the stationary bedknife.

In addition to an initial adjustment that would be required for a chipper apparatus, later reset adjustments of the disc relative to the bedknife in terms of clearance may be required. For example, such adjustments may be required when a bedknife or bedknife liners have been changed, when knife segments of the rotary disc have been changed, when new cutting knives having different widths than knives just removed from the rotary disc are employed, or when the axial position of the disc has been adjusted for any reason, such as during a maintenance procedure.

Referring to FIGS. 1-3, and in order to provide this type of adjustment for known chipping apparatus, it has previously been necessary for two persons to utilize a large open end wrench 130 and sledgehammer 140 to first loosen a clamping or locking nut 104 in order to loosen the locking nut from an adjusting nut 120.

After the locking nut 104 has been loosened, it is still necessary for at least one operator to use a large open end wrench 130 and sledgehammer 140 in order to selectively turn the adjusting nut 120 in order to axially adjust a chipper thrust screw away from the bedknife in order to increase clearance between the rotary cutting knives of the cutting disc and the bedknife or alternatively, to pull the chipper thrust screw and the rotary disc toward the stationary bedknife.

In brief, movement is facilitated in the chipper apparatus shown in FIGS. 1-3 using a thrust bearing assembly in which the adjusting nut 120 and the locking nut 104 are each attached to a coaxial displaceable shaft whose output is connected to a thrust bearing cartridge assembly, which is axially movable, the cartridge being attached to the shaft of the chipper disc.

Following the above known adjustment procedure, it is necessary to lock the above assembly in place in the desired position prior to chipper operation. To accomplish the task of setting the cutting disc into position and locking it there, the adjusting nut 120 must be rotated in one direction (e.g., clockwise) in order to shift the large rotary disc toward the stationary bedknife. The adjusting nut 120 must then be rotated in the opposite direction in order to remove slack from the assembly and the locking nut 104 must be tightened until the locking nut firmly engages the adjusting nut 120. Again and as shown in FIG. 1, at least two persons are required wherein one person must support the large wrench 130 onto the adjusting nut 120, while the other person uses a separate wrench 130 and sledgehammer 140 in order to tighten the locking nut 104.

Other assemblies for adjusting the clearance position of the rotary cutting disc of chipper apparatus are known, such as described, for example, in U.S. Pat. No. 5,727,611. These assemblies are relatively complex and also require separate and various loosening and tightening procedures in order to effect adjustment.

There is a need to simplify and improve the adjustment procedure such that a single person can perform this procedure, as needed, and also such that adjustments can be made reliably and expediently.

SUMMARY OF THE INVENTION

According to one exemplary aspect, there is provided an adjustment mechanism for a chipper apparatus, said chipper apparatus including a rotary disc having a plurality of cutting blades, a disc shaft supporting said disc, and a stationary bedknife wherein said mechanism adjusts the relative clearance between said cutting blades and said bedknife, said adjustment mechanism including an axially displaceable shaft, at least one gear disposed in relation to said axially displaceable shaft, and means for engaging said at least one gear to effect rotation thereof so as to produce axial movement of said axially displaceable shaft wherein the output of said axially displaceable shaft is connected to an axially movable cartridge, said disc shaft being connected to said cartridge to produce corresponding movement of said rotary disc.

According to one version, the at least one gear includes a worm gear that can be engaged using a worm drive disposed on a manually operable member, such as a crank member. The worm gear is disposed in relation to the axially displaceable shaft such that rotation of the worm gear causes corresponding rotation of the displaceable shaft. The worm drive engages the worm gear and causes reduced rotation of the displaceable shaft, the shaft being connected to the chipper disc through the movable cartridge to selectively effect adjustment for clearance purposes.

According to one version, the crank member can be manually rotated using an extending handle. Alternatively, the crank member can be connected to a small hydraulic, electric or other suitable form of motor that selectively produces drive capability.

According to another exemplary aspect, there is provided a chipper apparatus comprising a rotary cutting disc having a series of radially disposed cutting blades along one side thereof, a center shaft attached to said cutting disc and extending perpendicular to the plane of said chipper disc, a stationary knife disposed in relation to said series of cutting blades of said cutting disc, and an adjustment apparatus for adjusting the axial position of the rotary cutting disc relative to the stationary knife. The adjustment apparatus includes an axially displaceable shaft attached to the center shaft of the chipper disc, at least one gear engaged with the axially displaceable shaft, and an engagement member for engaging the at least one gear to effect rotation of the axially displaceable shaft and subsequent movement of the chipper disc relative to the stationary knife.

According to one version, the center shaft of the rotary cutting disc is attached to a movable cartridge as is the output of the axially displaceable shaft. Engagement upon the at least one gear therein causes axial movement of the axial displaceable shaft and further permits movement of the cartridge, thereby causing subsequent movement of the center shaft/cutting disc.

Preferably, the adjustment mechanism includes a locking or clamping nut engaged with an extending end of the axially displaceable shaft, i.e., the end opposite to that of the end attached to the cartridge, and further engaged with the worm gear such that the nut must be loosened to initiate adjustment of the cutting disc. The clamping nut can be attached to the adjustment mechanism by fasteners to permit rapid loosening of the nut without use of large wrenches and the like, as needed in prior art mechanisms.

Advantageously, the herein described adjustment apparatus provides safer operation than previously known apparatus or systems that are used for this purpose. The use of gearing for adjusting the rotary cutting disc, in lieu of an adjusting nut, permits relative adjustment without having to employ a giant open-ended wrench and a sledgehammer and/or requiring two persons for the handling of same.

In addition, the herein described adjustment mechanism also provides improved savings in time over previously known blade adjustment methods. As noted, the use of a worm gear with a rotatable crank member, for example, is much more efficient in that only a single person is required to carry out needed disc clearance adjustments. Moreover, this system is also adaptable to a number of chippers that are existing already in the field.

The use of a worm gear drive, in particular, provides a greater mechanical advantage due to its high gear ratio. This, in turn, allows the chipper disc to be axially adjusted in very small increments. In most applications, a rotary cutting disc is rarely adjusted more than about 0.25 inches, but it is typically adjusted in increments of thousandths of inches. The herein described adjustment system permits fine adjustment to be done using relatively gross movements of the engagement member, an advantage not realized by currently known apparatus. In lieu of a worm gear, however, it should be noted that the herein described disc adjustment system can alternatively include other forms of gearing to provide the above noted effects. For example, a planetary gear set, a spur and helical gear set, or a combination of each can be utilized.

These and other features and advantages will be readily apparent from the following Detailed Description which should be read in conjunction with the accompanying drawings.

DETAILED DESCRIPTION

The following description relates to an exemplary embodiment of a disc adjustment mechanism for a rotary chipper apparatus. Throughout the course of discussion that follows, certain terms such as "top". "bottom", "lateral", "axial", "distal", "proximal" and the like are used in order to provide a convenient frame of reference with regard to the accompanying drawings. These terms are not intended to be specifically limiting, except where so specifically indicated.

Reference is first made to FIGS. 1-3 and FIGS. 9 and 10 to provide additional background and detail of operation relating to a prior art chipper apparatus for purposes of the present invention.

Figure 10:
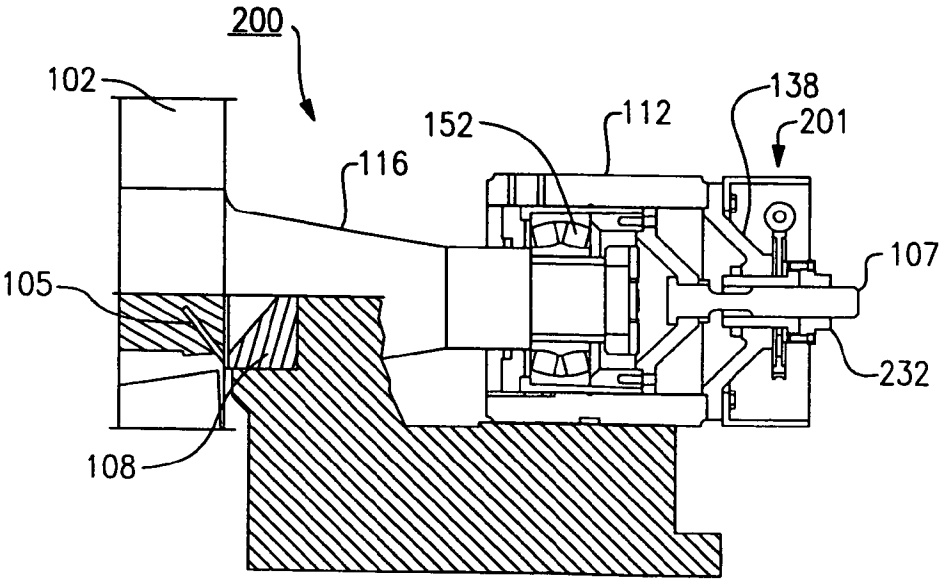
FIG. 10 is an enlarged partial side elevational view of the chipper apparatus of FIG. 9, partially in section, including the manual disc adjustment system of FIGS. 4-9.
Figure 9:
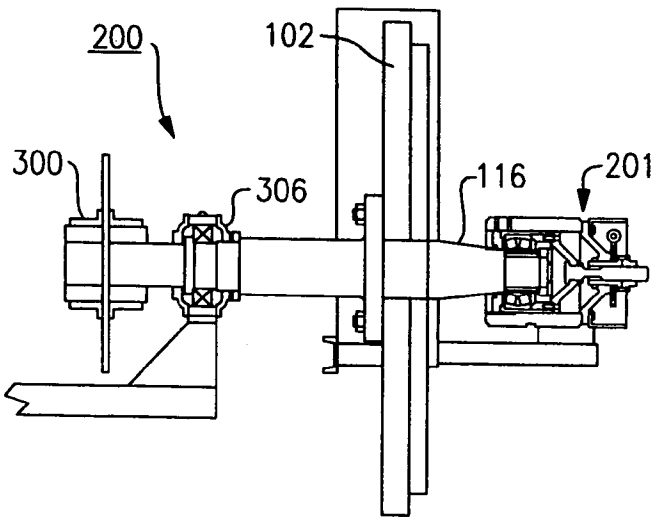
FIG. 9 is a side view of a chipper apparatus, including the manual disc adjustment mechanism of FIGS. 4-8.

Referring briefly to FIGS. 9 and 10, a chipper apparatus is shown, the apparatus including an adjustment mechanism of the cutting disc 102 that is provided on one side of the apparatus wherein the cutting disc 102 is supported on each side of the chipper apparatus. Though FIGS. 9 and 10 each illustrate a rotary chipper apparatus having an adjustment mechanism 201 in accordance with an exemplary embodiment of the invention, the relative placement of the mechanism and the overall construction and workings of the chipper apparatus are identical. In fact, one aspect of the present invention is that the adjustment mechanism can be retrofitted into an existing chipper apparatus, as described in greater detail below. For purposes of this explanation, however, and with regard to the remainder of the chipper apparatus, the chipper disc 102 is supported at each end wherein the side of the apparatus 200 opposite to that of the adjustment mechanism 201 includes a drive mechanism 300 for the cutting disc 102, including a brake mechanism 306 disposed between the drive mechanism and the cutting disc. Details relating to each of the drive mechanism and brake mechanism are not required for an understanding of the present invention and have been presented for background purposes only.

As shown in FIG. 10, the large rotary cutting disc 102 includes a series of cutting knives 105 (only one being shown) mounted on a facing side thereof. The drive mechanism 300, FIG. 9, of the chipping apparatus 100 rotates the cutting disc 102 and the cutting knives 105 sequentially past a cutting position in relation to the stationary anvil 108 (i.e., bedknife) to permit chipping of logs (not shown) that enter the chipper apparatus 100 through a feed chute 110, the latter being only shown in FIG. 1.

Figure 2:
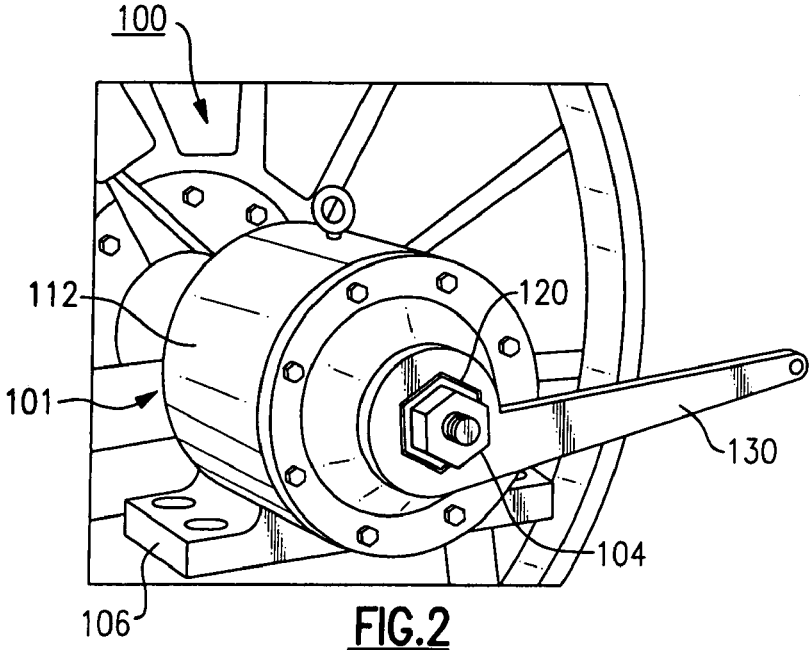
FIG.2 Prior Art
FIG. 2 is a partial end perspective view of the prior art chipper apparatus of FIG. 1, illustrating a subsequent step of the rotary disc adjustment procedure.
Figure 3:
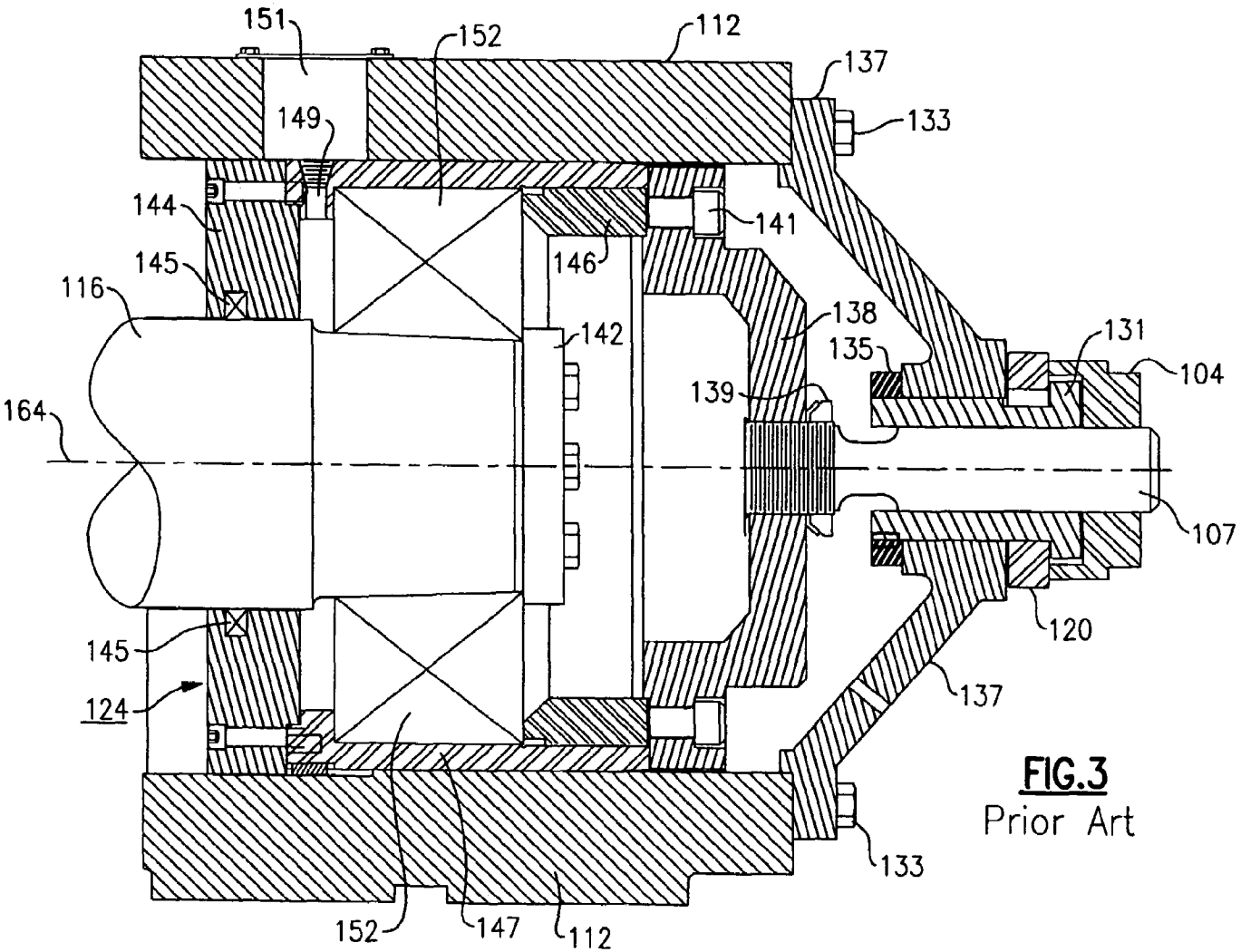
FIG.3 Prior Art
FIG. 3 is a partial sectioned view of the disc adjustment mechanism of the prior art chipper apparatus of FIGS. 1 and 2.
Figure 8:
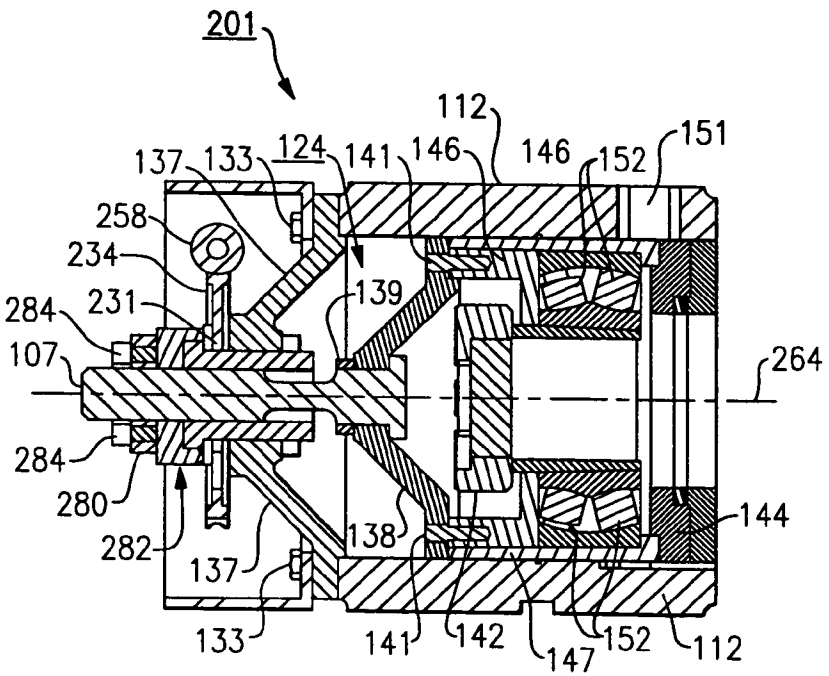
FIG. 8 is a sectioned side elevational view of the manual disc adjustment mechanism of FIGS. 4-7, as taken through line 8-8 of FIG. 6.
Figure 7:
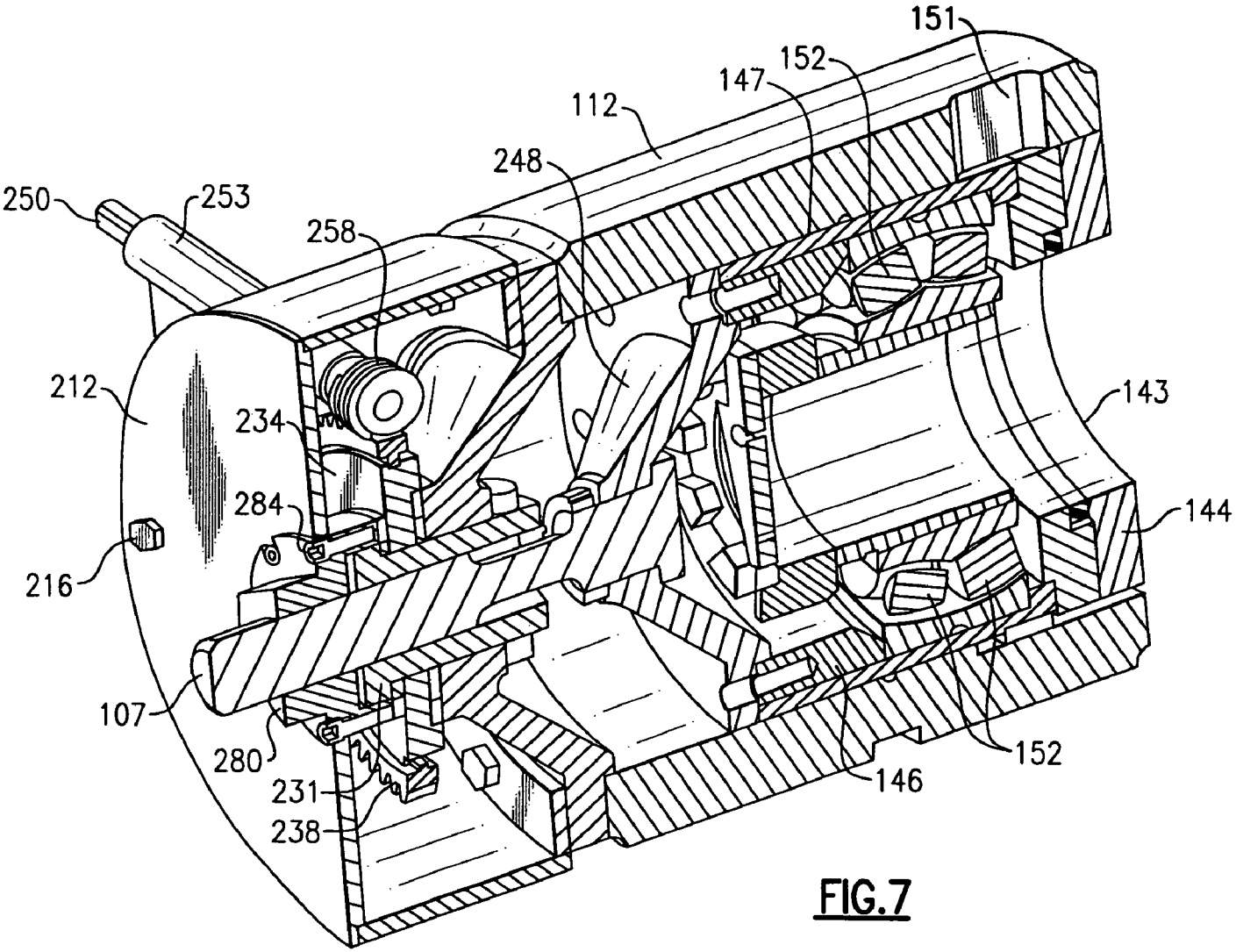
FIG. 7 is a sectioned view taken through the centerline of the disc adjustment mechanism housing.

Referring to FIGS. 2 and 3, the disc adjustment mechanism 101 includes a housing 112 having a base 106 that permits attachment of the mechanism to a horizontal surface (not shown). The entire adjustment mechanism is self contained within the housing 112 and is therefore adaptable with the disc shaft 116 of numerous rotary disc chippers. As shown particularly in FIG. 3, one extending end of the center chipper disc shaft 116 is fitted within the interior of the housing 112, and more particularly within a defined cavity or chamber of a thrust bearing cartridge assembly 124 having a portion that is movably attached within the housing 112. The end of the disc shaft 116 extends, according to this apparatus, through an opening 143, shown in FIGS. 7 and 8, provided in a seal plate 144 into the defined interior chamber, the latter including at least one roller bearing 152, such as spherical roller bearings, which are provided in relation to the entering disc shaft 116. A quantity of hydraulic fluid (not shown) is added to the defined chamber through a radially disposed fill plug 149 via an access port 151 that is provided in the top of the housing 112. Alternatively, grease may be used in lieu of hydraulic fluid in order to lubricate the bearing 152. The seal plate 144 is mounted in a direction that is substantially perpendicular to the axis 164 of the shaft 116 (e.g., vertical) and includes a peripheral seal ring 145. Alternatively, an additional filler plate 148, shown only in FIG. 8, may also be used in relation to the seal plate at the end of the housing 112 or other types of shaft seals (e.g., labyrinth lip seals, V-rings, and the like). The seal plate 144 is attached using fasteners to a carrier sleeve 147 adjacent the interior surface of the housing 112 forming the wall of the interior chamber.

The inner race of the bearing 152 is secured to the shaft 116 through conventional means; e.g., an interference fit, tapered sleeve, clamping nut or other suitable connection. The outer (i.e., non-rotating) race of the bearing 152 is fixed/clamped axially within the cartridge assembly 124 between a shoulder providing axial position limitation within the bearing carrier sleeve 147 and a bearing locking ring 146 that is externally threaded or otherwise anchored to the carrier sleeve 147 and mechanically adjustable to be axially tight to the other side of the outer race of the bearing 152, thereby totally capturing the outer race of the bearing 152 within the cartridge assembly 124.

The bearings 152 are retained on an opposite axial side of the cartridge assembly 124 by means of a bearing retaining plate 142. The output of an axially displaceable shaft 107 is attached to the axially movable portion of the non rotating cylindrical thrust bearing cartridge assembly 124. The axially displaceable shaft 107 is disposed within the confines of an adjusting sleeve 131 having threading to engage with the exterior threads of the shaft. A thrust plate 137 is secured between the adjusting nut 120 and a lock nut 135, both also being engaged on the exterior of the adjusting sleeve 131. The thrust plate 137 is defined by a center cylindrical portion having an opening sized to retain the shaft 107 and adjusting sleeve 131, as well as an exterior tapered section extending radially outward and fixedly mounted to the housing 112 by means of cap screws 133 or other fasteners. The exterior tapered section according to this embodiment is frusto-conical in shape, however, any desired configuration can be used to extend between a smaller sleeve diameter for receiving the distal end of the axially displaceable shaft 107 and the interior wall of the housing 112.

The adjusting nut 120 is engaged with the exterior of the adjusting sleeve 131 and is disposed between the proximal wall of the center portion of the thrust plate 137 and a shoulder of the adjusting sleeve 131. The clamping or locking nut 104 is engaged at the end of the extending axially disposable shaft 107 and includes a center opening permitting the shaft end to pass therethrough. The nut 104 is threadingly engaged with the axially displaceable shaft 107 and upon locking is engaged into direct abutting contact with the adjusting nut 120. The locking nut 104 covers the proximal end of the adjusting sleeve 131 and abuts the adjusting nut 120 such that the clamping nut must be loosened prior to adjustment of the disc shaft 116 (and cutting disc 102, shown in FIG. 10). The opposite or distal end of the axially displaceable shaft 107 extends from the adjusting sleeve 131 and is fitted within a center opening of a thrust flange 138 having its own lock nut 139, the thrust flange 138 being attached fixedly by a plurality of cap screws 141 to the axially movable portion of the thrust bearing cartridge assembly 124. More specifically, the thrust flange 138 engages a bearing locking ring 146 disposed within the periphery of the carrier sleeve 147 adjacent the interior surface of the housing 112.

As noted above and as shown in FIG. 1, a sledge hammer 140 and large open-ended wrench 130 are first required in order to loosen the locking nut 104 of the herein described adjustment mechanism 101 and eliminate the axial "pinch" by the locking nut 104 so as to release the adjusting nut 120, allowing same to rotate easily. The adjusting nut 120 is then also rotated by the operator, as shown in FIG. 2, such rotation of the adjusting nut 120 and internally threaded adjusting sleeve 131 on the externally threaded shaft 107 bringing about a corresponding axial movement of the shaft 107. This displacement causes subsequent axial movement of the thrust bearing cartridge assembly 124 within the housing 112 and therefore corresponding movement of the chipper disc shaft 116, FIG. 3, relative to the stationary bedknife 108, FIG. 10.

Referring to FIGS. 4-10, there is shown an adjustment mechanism 201 for a rotary disc chipper apparatus 200 made in accordance with an exemplary embodiment of this application. For purposes of this discussion and for the sake of clarity, similar parts to those already described in FIGS. 1-3 will be labeled with the same reference numerals.

Figures 4, 5:
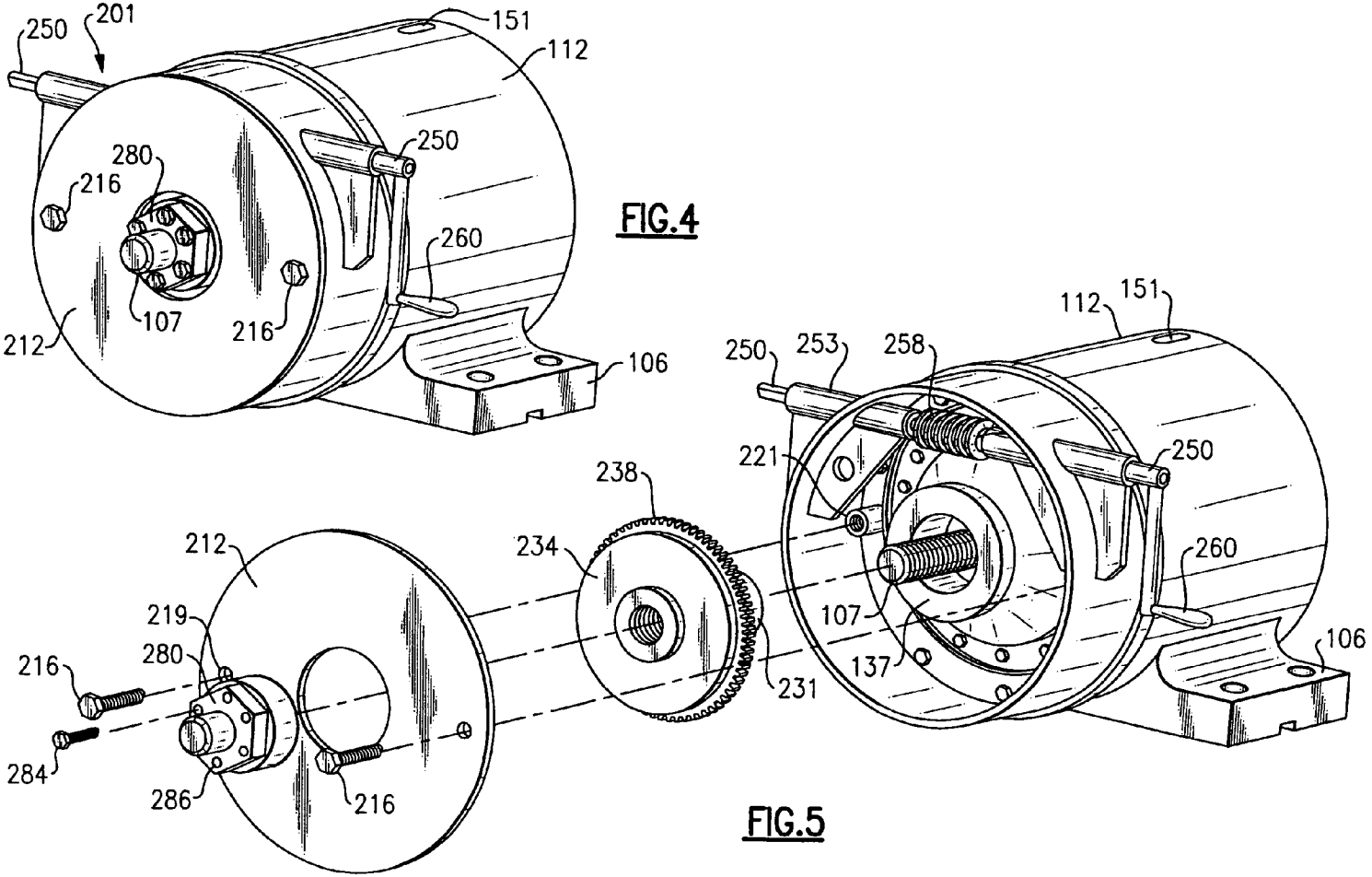
FIG. 4 is a partial end perspective view of a manual disc adjustment mechanism for a chipper apparatus.
FIG. 5 is a partially exploded end perspective view of the manual disc adjustment mechanism of FIG. 4.

As in the preceding, the adjustment mechanism 201 comprises a housing 112 having a base 106 to permit mounting of same to a horizontal surface (not shown). The housing 112 is defined by an interior chamber that is sized to receive a number of components and further includes an end cover 212 that is secured to the housing by a plurality of bolts 216, as shown in FIGS. 4 and 5, the bolts being attached through openings 219 in the end cover to posts 221 provided in the housing.

According to this exemplary embodiment and referring to FIGS. 4-7, a thrust bearing cartridge assembly 124 complete with axially displaceable shaft 107 is provided, analogous to that described previously with regard to FIGS. 1-3, the cartridge assembly receiving an end of the chipper disc shaft 116 of the large rotary cutting disc 102, the shaft and disc being shown only in FIG. 10. An axially displaceable shaft 107, the shaft including a set of external threads, is threadingly fitted within an adjusting sleeve 231, the sleeve having a set of complementary threads (not shown). Unlike the adjusting nut 120 previously used in the prior art apparatus of FIGS. 1-3, gearing such as a worm gear 234 is circumferentially disposed about the axially displaceable shaft 107 and the adjusting sleeve 231, the worm gear having a center opening for accommodating the shaft and sleeve as well as a plurality of exterior gear teeth 238. The worm gear 234 is keyed to the adjusting sleeve 231, the threads of which engage the threads of the axially displaceable shaft 107. The output of the adjusting sleeve 231 is connected to the axially displaceable shaft 107 and subsequently a movable portion of the thrust bearing cartridge assembly 124, as previously described.

As with the preceding mechanism, the adjusting sleeve 231 is restrained axially by a thrust plate 137. Therefore, the rotational output of the gear 234 and adjusting sleeve 231 on the shaft 107 axially positions the shaft 107, and therefore also axially positions the cartridge assembly 124 and disc shaft 116, FIG. 10.

A crank member 250 disposed in relation to the top of the interior of the assembly housing 112, includes a heavy duty worm drive 258 for engaging the exterior teeth 238 of the worm gear 234.

The shaft of the crank member 250 is, with the exception of the worm drive 258, disposed within a receptacle 253 extending transversely through the interior of the housing 112. The crank member 250 further includes a downwardly extending portion having a handle 260 at one end that enables rotation of the crank member about an axis defined by the cylindrical receptacle 253, this axis being tangential to the exterior gear teeth 238 of the worm gear 234. The crank member 250 can be mounted such that the handle 260 is at either side of the housing 112; that is, the crank handle can be oppositely mounted to that shown herein. Rotation of the crank member 250, either clockwise or counterclockwise, causes rotation of the worm drive 258 and therefore corresponding rotation of the worm gear 234 which is keyed to the adjusting sleeve 231. The worm gear 234 according to this embodiment includes 30 to 150 external teeth 238 and the worm drive 258 is defined such that a 72:1 gear reduction is provided. That is, for each full 360° rotation of the crank member 250, a corresponding 5 degrees of rotation of the adjusting sleeve 231 will result and bring about an axial movement of approximately 0.003 inches of the displacement shaft 107, enabling fine axial adjustment using relatively gross movements of the engagement (crank) member. It should be readily apparent that other suitable ratios can be provided.

Figure 1:
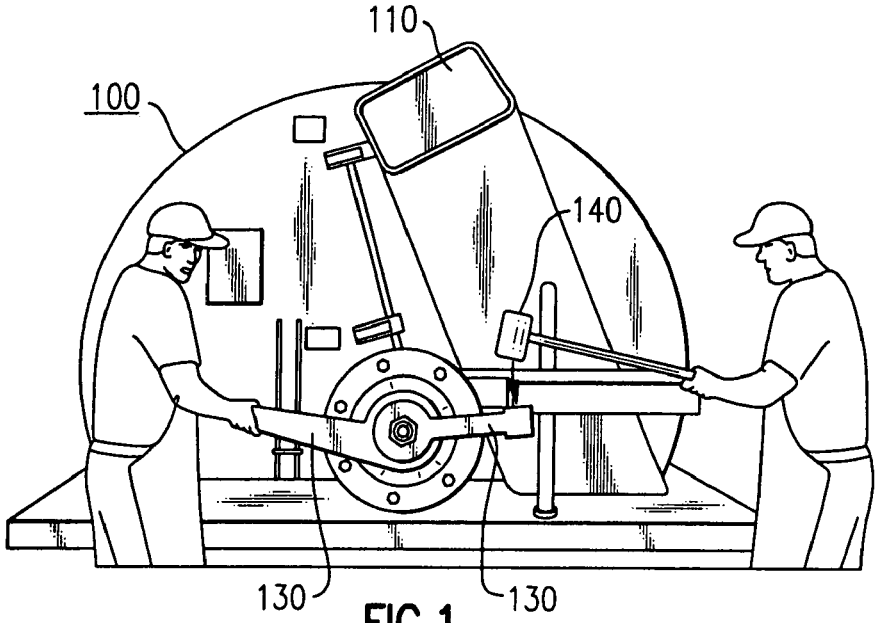
FIG.1 Prior Art
FIG. 1 is an end view of a prior art chipper apparatus illustrating a portion of a rotary cutter disc adjustment procedure.
Figure 6:
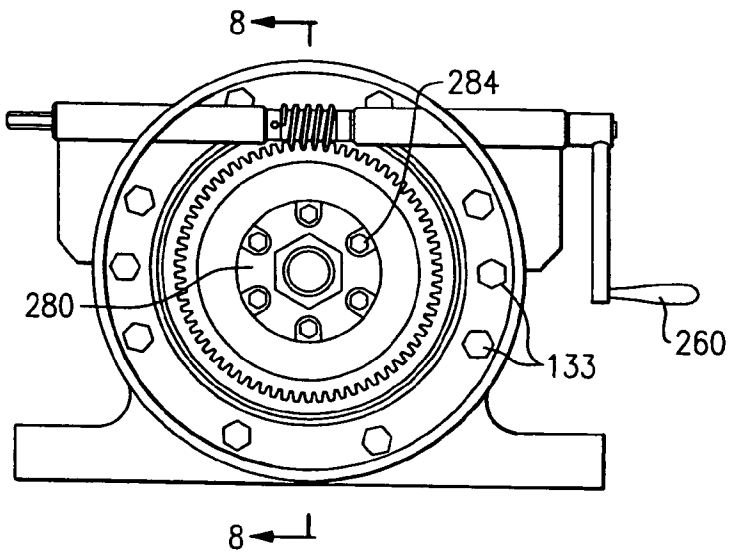
FIG. 6 is an end view of the manual disc adjustment mechanism of FIGS. 4 and 5, with the end cover removed for clarity.

The present disc adjustment mechanism 201 can include a clamping or locking nut 104, such as that previously described in the disc adjustment mechanism of FIGS. 1-3. Alternatively and as depicted in FIGS. 6-8, a different nut 280 can be used to clamp the adjusting nut/worm gear 234 and adjusting sleeve 231 into a desired set position. The nut 280 includes a plurality of threaded openings 286 that are disposed peripherally about a center opening 288 for accommodating a corresponding plurality of fasteners 284. The center opening 288 of the nut 280 accommodates the extending (i.e., the proximal) end of the axially displaceable shaft 107 wherein the nut is attached via its internal threads to the shaft 107. A clamping force from the nut 280 is achieved against the adjusting nut/worm gear 234, by means of the plurality of fasteners 284. The nut 280 shown in FIGS. 6 and 8 is slightly different than that illustrated in FIG. 7 in the placement of the threaded openings 284 about the periphery of the nut. The function and operation of the nut 280, however, is unchanged in either version. In the version depicted in FIG. 8, an intermediate collar 282 having a counter bore is fitted over the proximal end of the adjusting sleeve 231 extending through the worm gear 234. Each of the fasteners 284 in this version engage against the collar 282. In the version shown in FIG. 7, the fasteners 284 engage directly against the face of the worm gear 234, since the fasteners are disposed radially of the extending adjusting sleeve 231. In this version, no collar is required.

In operation, an operator would selectively perform a cutting disc clearance adjustment procedure as follows: First, the clamping nut 280 is loosened using a torque wrench to loosen each of the fasteners 284 from the face of the worm gear 234. This loosening permits the worm gear 234 and keyed adjusting sleeve 231 to rotate. Clearance adjustment of the cutting disc 102 is then performed, according to the present embodiment, by access to the crank handle 260 and by rotating the crank member 250 in either the clockwise or counterclockwise direction, causing the displaceable shaft 107 and keyed adjusting sleeve 231 to rotate about the axis 264, FIG. 8, and cause the extending end of the shaft 107 and the movable portion of the thrust bearing cartridge assembly 124 to move in unison. As noted, the gear reduction of the worm gear 234 permits fine adjustment (0.003 inches of displacement for a single rotation of the crank member 260 according to this specific embodiment) with relatively gross movements of the crank member.

PARTS LIST FOR FIGS. 1-10

100 chipper apparatus
101 adjustment mechanism
102 rotary disc
104 locking nut
105 cutting knives
106 base
107 axially displaceable shaft
108 stationary anvil or bedknife
112 housing
116 chipper disc shaft
120 adjusting nut
124 thrust bearing cartridge assembly
130 open-ended wrench
131 adjusting sleeve
133 cap screws
135 lock nut
137 thrust plate
138 adjusting sleeve
140 hammer
141 cap screws
142 bearing retaining plate
143 openings
144 seal plate
145 peripheral seal ring
146 bearing locking ring
147 carrier sleeve
148 filler plate
149 fill plug
151 port, access
152 spherical roller bearings
164 axis
201 adjustment mechanism
212 end cover
216 bolts
219 openings
221 posts
231 adjusting sleeve
234 worm gear
238 exterior teeth
250 crank member
258 worm drive
260 handle, crank
264 axis
280 nut
282 collar
284 fasteners
286 openings
288 center opening
300 drive mechanism
306 brake mechanism While the present invention has been particularly shown and described with reference to the preferred mode as illustrated in the drawings, it will be understood by one skilled in the art that various changes in detail may be effected therein without departing from the spirit and scope of the invention as defined by the claims. For example and in lieu of using a worm gear, planetary or other gearing can be utilized in place of the adjusting nut in order to provide adjustment capability.

I claim:

1. In combination, an adjustment mechanism for use in a chipper apparatus, said chipper apparatus including a rotary disc having a plurality of cutting blades and a disc shaft supporting said disc and a stationary bedknife wherein said adjustment mechanism adjusts the relative clearance between said cutting blades and said bedknife, said adjustment mechanism comprising:

an axially displaceable shaft;

at least one gear disposed in relation to said axially displaceable shaft; and an engagement member disposed in relation to said at least one gear to effect rotation thereof so as to produce axial movement of said axially displaceable shaft wherein the output of said axially displaceable shaft is connected to an axially movable cartridge, said disc shaft being connected to said cartridge to produce corresponding movement of said rotary disc.

2. The combination as recited in claim 1, wherein said at least one gear includes a worm gear disposed in relation to said axially displaceable shaft and in which said engagement member includes a worm drive for actively engaging said worm gear.

3. The combination as recited in claim 2, wherein said engagement member includes a rotational crank member, said crank member including said worm drive.

4. The combination as recited in claim 2, wherein said crank member includes an exterior handle.

5. The combination as recited in claim 4, wherein said crank member can be placed on opposite sides of said adjustment mechanism.

6. The combination as recited in claim 2, wherein said worm drive is connected to a motor.

7. The combination as recited in claim 1, including a cartridge movably disposed between said axially displaceable shaft and said center shaft of said cutting disc.

8. The combination as recited in claim 1, wherein said at least one gear produces reduction such that gross movements of said engagement member produce fine displacements of said axially displaceable shaft and said cutting disc.

9. The combination as recited in claim 8, wherein said adjustment mechanism is contained within a housing, said housing including a base that is attachable to a chipper apparatus.

10. A chipper apparatus comprising:

a chipper disc having a series of cutting blades, said chipper disc having a center shaft attached to said chipper disc;

a stationary knife disposed in relation to said cutting blades of said chipper disc; and an adjustment apparatus for adjusting the position of the chipper disc relative to the stationary knife, said adjustment apparatus including an axially displaceable shaft attached to the center shaft of said chipper disc, at least one gear disposed onto said axially displaceable adjusting shaft, and an engagement member for engaging said at least one gear to effect rotation of said axially displaceable shaft and subsequent axial movement of said chipper disc relative to said stationary knife.

11. A chipper apparatus as recited in claim 10, wherein said adjustment apparatus is removably attached to said apparatus.

12. A chipper apparatus as recited in claim 10, wherein said at least one gear includes a worm gear disposed in relation to said axially displaceable shaft and in which said engagement member includes a worm drive for actively engaging said worm gear.

13. A chipper apparatus as recited in claim 12, wherein said engagement member includes a crank member having said worm drive.

14. A chipper apparatus as recited in claim 13, wherein said crank member includes an exterior handle.

15. A chipper apparatus as recited in claim 14, wherein said exterior handle of said crank member can be placed on either of opposing lateral sides of said mechanism.

16. A chipper apparatus as recited in claim 12, wherein said worm drive is connected to a motor.

17. A chipper apparatus as recited in claim 10 wherein the center shaft of said cutting disc is attached to and retained by a movable cartridge assembly, said axially displaceable shaft also being attached to said movable cartridge assembly.

18. A chipper apparatus as recited in claim 17, wherein said axially displaceable shaft is keyed to a sleeve that is attached to said movable cartridge assembly and to said at least one gear such that rotation of said gear by said engagement member causes rotation of said sleeve and axially displaceable shaft and subsequent movement of said cartridge assembly and retained disc shaft.

19. A chipper apparatus as recited in claim 18, including a locking nut disposed on an extending end of said axially displaceable shaft opposite said cartridge assembly, said clamping nut being engaged with said a face surface of said at least one gear.

* * * * *